United States Patent [19]

Brooks, II

[11] 4,351,547

[45] Sep. 28, 1982

[54] SECURITY DOCUMENT AND METHOD FOR MAKING SAME USING AN ALTERNATING DOT PATTERN

[75] Inventor: David L. Brooks, II, Fairport, N.Y.

[73] Assignee: Burroughs Corporation, Detroit, Mich.

[21] Appl. No.: 83,763

[22] Filed: Oct. 11, 1979

[51] Int. Cl.[3] ..... B42D 15/00

[52] U.S. Cl. ..... 283/8 R; 283/58

[58] Field of Search ..... 283/58, 8 R, 8 B, 6, 283/8 A, 9

[56] References Cited

U.S. PATENT DOCUMENTS

| | | | |
|---|---|---|---|
| 3,675,948 | 7/1972 | Wicker | 283/8 B X |
| 4,168,088 | 9/1979 | Somlyody | 283/8 R |
| 4,210,346 | 7/1980 | Mowry, Jr. | 283/8 B |
| 4,227,719 | 10/1980 | McElligott | 283/8 R |
| 4,227,720 | 10/1980 | Mowry, Jr. | 283/8 R |
| 4,265,469 | 5/1981 | Mowry, Jr. | 283/8 B |

*Primary Examiner*—Paul A. Bell
*Assistant Examiner*—John S. Brown
*Attorney, Agent, or Firm*—David G. Rasmussen; Kevin R. Peterson

[57] ABSTRACT

An improved copy-proof document is disclosed having a cancellation phrase with an alternating dot pattern which enhances both the detail rendition and protection of such documents. The method of making such a document by preprinting the cancellation phrase in a single tone pattern of alternating dot sizes is also disclosed.

7 Claims, 6 Drawing Figures

SECURITY DOCUMENT AND METHOD FOR MAKING SAME USING AN ALTERNATING DOT PATTERN

RELATED APPLICATIONS

This application relates to similar subject matter as that contained in the following U.S. Pat. Nos. 4,265,469 and 4,210,346 and 4,168,088.

The entire contents of each of the above applications is hereby incorporated herein by this reference.

BACKGROUND OF THE INVENTION

In the past, as illustrated in the above applications, conventional copy-proof documents were comprised of a single tone cancellation phrase ("VOID", "COPY", etc.) and a single tone background pattern. Tone, is this context, refers to the dots or marks which cover a percentage of the printed area and have a frequency measured in dots, marks or lines per inch. The cancellation phrase was composed of a tone slightly larger in percentage, but significantly lower in frequency than the background tone.

Many different combinations were possible. For example, the cancellation phrase or void word could cover 22% (printed dot diameter of approximately 0.010 inches) with a frequency of 65 lines per inch. The background pattern in this instance could be 16% (printed dot diameter of approximately 0.005 inches) with a frequency of 133 lines per inch. Another example might use the same frequencies, but a void word composed of 15% (printed dot diameter of 0.008 inches) and a background of 10% (printed dot diameter of 0.003 inches).

The above techniques were successful and for properly printed documents the protection was excellent for normal settings of copiers such as the Xerox L-6500 color copier or similar equipment. However, protection was less than adequate for a full range of copier settings. At the lighter settings the resolution of the copier is such that it does not see the smaller background dots nor can it reproduce the larger dots that comprise the cancellation phrase. If the dot sizes are adjusted so that the cancellation phrase is visible at the lighter copier settings but not visible on the printed document, the background pattern becomes visible to the copier at darker settings. When this occurs the background pattern tends to obscure the cancellation phrase pattern.

The aesthetic quality of these documents is limited by three inherent weaknesses. First, the ability of screened tones to print detailed patterns. To fully reproduce a pattern with a screen tint, the pattern must be at least two line widths at its narrowest points. A 133 lines per inch tint can then carry print down to 0.0150 inches. The customary screen paired with it is a 65 line per inch tint. It can reproduce detail to only 0.030 inches. One can conclude that the quality of detail in a printed manuscript is limited by the size of the largest dots.

Secondly, the questionable accuracy in the frequency of screen tints can cause problems at the boundary between the cancellation phrase and the background. The most successful screen pair thus far has been the 65 and 133 lines per inch combination. As one can see, these are not exact multiples. Also, they are production quality screens and are at best accurate to $\pm 1.5$ lines per inch for the 65 lines per inch tint and $\pm 3.0$ lines per inch for the 133 lines per inch tint. This mismatch (as opposed to exact multiples) in frequency causes interference patterns at the boundaries. This is analogous to playing a chord on an out of tune piano; just as the tonal inaccuracies are audible, so are the boundaries visible.

Finally, even if the frequencies are matched as exact multiples (i.e. 65 and 130 lines per inch) the transition is still not hidden from the human perception. This can again be illustrated by a musical analogy. If we were to play a note on a piano, then play the same note but a step higher (a multiple of the original frequency) the transition is smooth. But even someone who is tone deaf can distinguish between the two frequencies. If we use a camouflage screen made up of a random pattern, or a very bold pattern, it tends to obscure the difference. But for a pattern that is not bold or is fairly regular, the transition in frequency becomes more noticeable.

SUMMARY OF THE INVENTION

The document of the present invention is similar to earlier copy-proof systems in that it includes a document with a single tone background and a single tone cancellation phrase. However, the single tone of the cancellation phrase is not composed of individual areas of the same size and frequency as in the more conventional method. Rather, the cancellation phrase is composed of an alternating dot pattern which includes large dots of a lower frequency than the background tone and small dots located in exact registration with the large dots.

It is therefore an object of this invention to provide an improved copy-proof document having a cancellation phrase which is more versatile than earlier systems in that the number of patterns and pantographs which may be applied to such documents will be increased.

It is a further object of the present invention to provide a copy-proof document which has a greater range of copy-proof protection since the cancellation phrase of this document will darken at darker copier settings of the copying machine.

It is a still further object of the present invention to provide a copy-proof document having greater aesthetic quality. That is, the print quality is improved by a less visible cancellation expression and the ability to reproduce fine detail.

These and other objects will become more apparant as each of the drawings is described in detail.

DESCRIPTION OF THE PREFERRED EMBODIMENT

Figure 1:
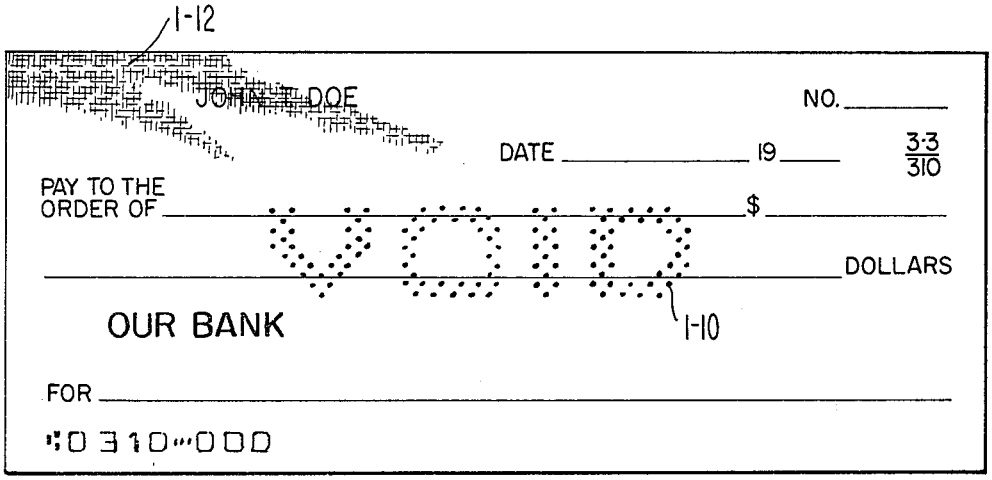
Fig. 1 PRIOR ART
FIG. 1 illustrates an example of a copy-proof document showing the "VOID" mark as it appears on a copy of an original document.

FIG. 1 illustrates a copy of a check on a color copier which check has the voiding features of this invention.

The word "VOID" 1-10 is readily sensed by the color copier and emphasized against the background 1-12. This basic feature is, of course, generally known and has been shown and described in the earlier related applications referenced earlier in this specification. However, as will be shown in more detail in FIGS. 2 and 3, this improvement will provide a better cover-up of the word VOID on the original document of the voiding feature, while at the same time providing a clear copy of the cancellation phrase.

Figure 2:
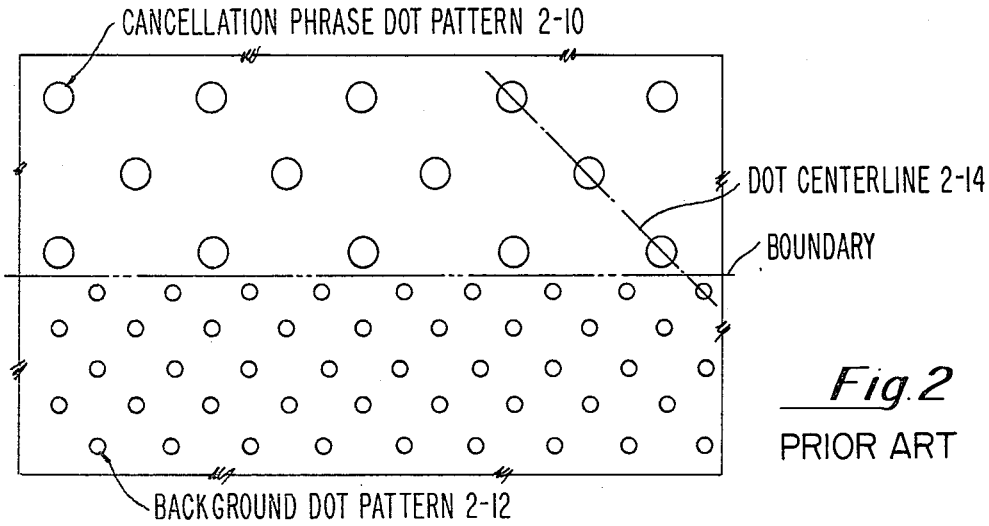
Fig. 2 PRIOR ART
FIG. 2 illustrates the cancellation phrase dot pattern of a conventional dot pattern.

FIG. 2 illustrates a detailed configuration of the conventional system. In this pattern a cancellation phrase dot pattern 2-10 is represented by a plurality of larger dots with sapce between said dots. The background pattern 2-12 has a larger number of smaller dots. It is the boundary area between the two patterns that causes the lack of a smooth transition between the two patterns.

Figure 3:
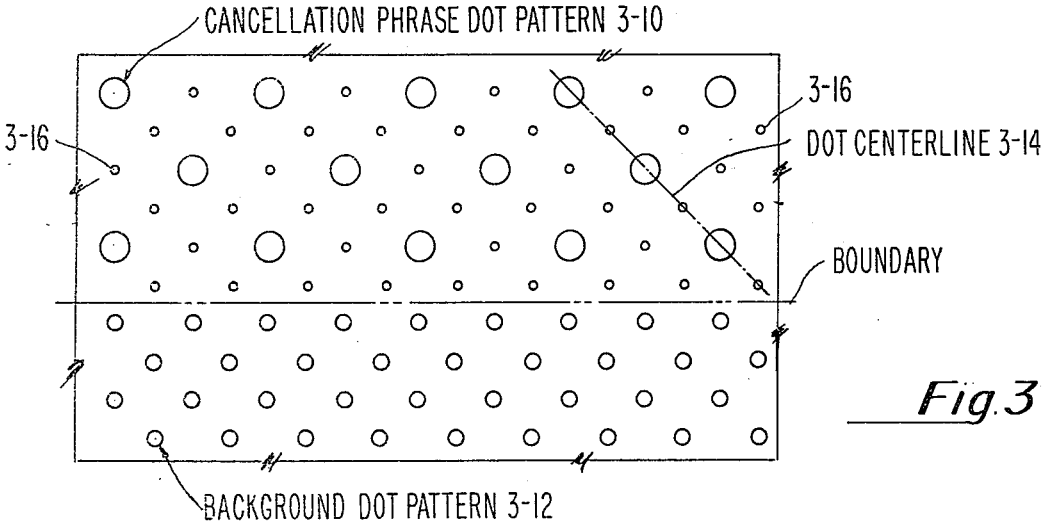
FIG. 3 illustrates the alternating dot pattern of the cancellation phrase of the present invention.

However, as is shown in FIG. 3, the dot cancellation pattern 3-10 has interspersed among the larger dots, a plurality of smaller dots 3-16 which correspond in center line configuration with the background dot pattern 3-12. The inclusion of these additional dots 3-16, allows the overall frequency of dots in the cancellation term to match the frequency of dots in the background pattern, providing a very smooth transition area at the boundary line and hence a more carefully hidden "VOID" word on the original document.

Figure 4:
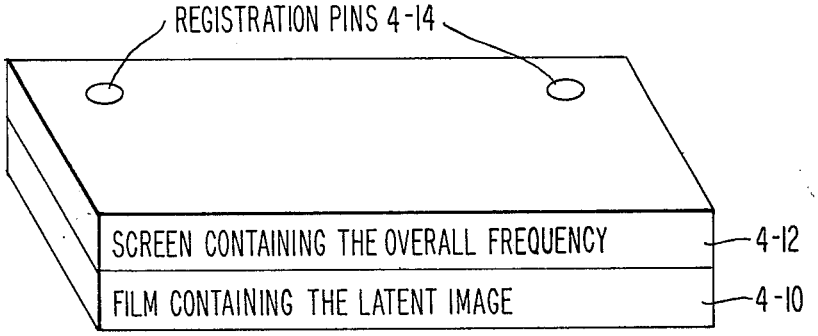
FIGS. 4, 5 and 6 illustrate the proposed steps of a method to produce the document of the present invention.
Figure 5:
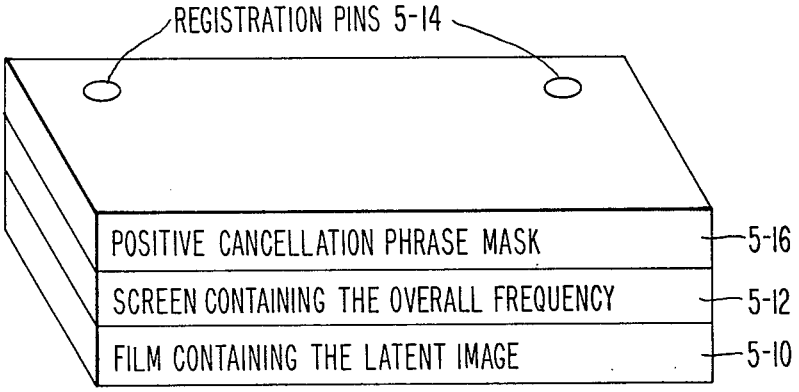
Figure 6:
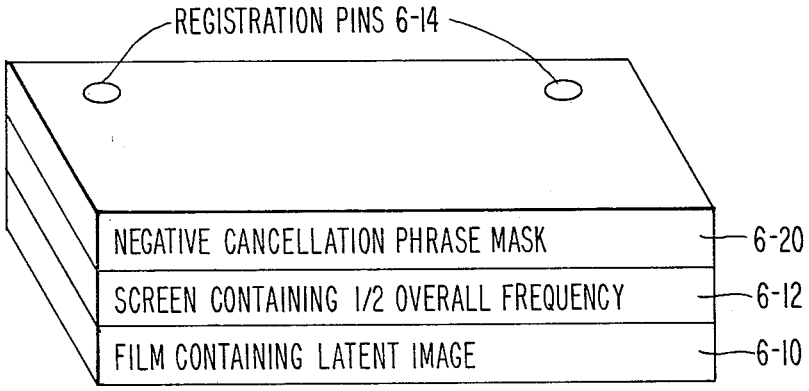

While the alternating dot pattern can be manufactured by many different techniques, the preferred method is illustrated by FIGS. 4, 5 and 6. This method is the conventional photographic technique.

In FIG. 4, the background screen 4-12 is placed over the photographic film 4-10 and exposed until the dot diameter is equal to the small dot diameter in the cancellation phrase area. A system of registration pins 4-14 is used to keep the screen 4-12 and film 4-10 in proper alignment.

FIG. 5 shows the addition of one positive cancellation phrase mask 5-16 to the screen 5-12 and the film 5-10. The exposure continues in this configuration until the desired background dot size is achieved. Thereafter, as is illustrated in FIG. 6, the mask 5-16 and the screen tint 5-12 of FIG. 5, are replaced by a negative of the mask 6-20 and a screen 6-18 of screen tint equal to exactly one-half of the frequency of the background. The screen 6-18 is located so that each dot of the screen corresponds exactly to a background dot. The film 6-10 is thereafter developed and when the proper camouflaging pattern is added, the resulting photographic negative or print can be used to produce printed documents.

The alternating dot pattern could also be produced by a photoplotter. Although this latter method is more expensive, it is much more accurate. One reason for the increased accuracy is that it is not produced in a single series of film. Rather it is produced on a single piece of film one dot at a time. The resulting screen pattern may be stored on magnetic tape and reproduced as required. However, regardless of the method used to produce the alternating dot pattern, the result is the same. Increased copy-proof protection and a more versatile, aesthetically pleasing document.

The copier protection of existing systems breaks down at the darker copier settings because the higher frequency background becomes visible to the copier. The cancellation phrase does not darken as quickly as the background and so the background diminishes the contrast of the copy-proof feature. The present alternating dot system, on the other hand, contains both the low frequency dots that copy over the entire copier range and the higher frequency dots which copy at the darker copier settings. Therefore, as the copier's resolution increases and the background becomes darker, the cancellation phrase also darkens.

The application of copy-proof documents has been limited by the inability of the previous technique to reproduce patterns that contain fine detail. As stated before, the smallest detail that can be printed is equal to twice the distance between dots. An example of the existing technique was comprised of a 65 lines per inch cancellation term screen. This translates into a reproducible detail of 0.030 inches. If a 130 lines per inch screen were to be used in the alternating dot pattern, the smallest reproducible detail would be 0.015 inches, one-half as small as the existing system.

The quality of copy-proof documents using existing techniques is not good, due to the visibility of the cancellation phrase. Since a bold or irregular pattern is needed to camouflage the voiding feature, it restricts the patterns or pantographs that may be used. There are three reasons the cancellation phrase is visible: the change in frequency of the screens, inaccurate alignment of the screens, and the discontinuity of the printed area across the boundary.

Because the alternating dot pattern has an overall frequency equal to that of the background, the change in frequencies will be less noticeable. That is not to say no differences exist; there is still a difference in the percent of area covered by the dots and a secondary frequency exists in the alternating dot pattern. But on a properly printed document the two screens should not be distinguishable by the unaided eye.

Since the alternating dot pattern is made by starting with a continuous screen of a single frequency, the dots are all equidistant from one another. This eliminates problems caused by aligning screens of two different frequencies by hand. The result is a continuous transition across the boundary between the voiding expression and background.

If the art work of the cancellation phrase is created so that the transition across the phrase and background boundary is similar to that in FIG. 3, the seam becomes even less visible. The boundary in the current system is visible because it leaves large unprinted areas or over printed dots. The border dots used in the alternating dot pattern do not leave large unprinted areas and therefore a smoother transition exists across the boundaries. By developing a less visible cancellation phrase a wider variety of patterns and pantographs may be used.

In conclusion, the alternating dot pattern of the present invention will improve present copy-proof documents in at least three areas. They are:

1. Versatility—the proposed system will increase the number of patterns and pantographs that may be applied to copy-proof documents, in particular custom pantograph backgrounds.

2. Copy-Proof Protection—the cancellation phrase will darken at darker copier settings to improve protection.

3. Aesthetic Quality—the printed quality is improved by a less visible cancellation expression and the ability to reproduce fine detail.

While several combinations are possible, a preferred combination to practice the present invention is:

BACKGROUND

The background dot pattern (3-12) with 130 line per inch frequency and with a 10% area covered (printed dot diameter of 0.003 inches).

CANCELLATION PHRASE

The cancellation phrase has an effective frequency of 130 lines per inch where both the large dots (3-10) and the small dots (3-16) are included. Since the large and small dots alternate, the large dots occur with a frequency of 165 lines per inch. The combined average of both the large and small dots gives the overall visual effect which must blend with the background area to produce a relatively even tone over the entire word and background areas when printed. A suitable combination of dot sizes and the cancellation word include small dots of 0.002 inches diameter and larger dots of 0.0063 inches diameter. These sizes give about 4% and 13% area covered, respectively, for a combined area covered of 17% or overall tint in the cancellation phrase of 17%.

Many modifications and other combinations are foreseen, however, it is intended that this concept only be limited to the full scope of the following claims.

What is claimed is:

1. An improved security document comprising:

a substrate having a top surface for carrying indicia;

background printed matter on said top surface, said background printed matter made up of a pattern of small elements of substantially the same size and of a uniform frequency; and, a cancellation term also printed on said top surface of said substrate, said cancellation term composed of an area pattern consisting of at least two sizes of elements uniformly spaced in an intermingling, alternating pattern and occurring with the same combined contiguous frequency as said elements of said background printed matter.

2. The apparatus of claim 1, further including:

a camouflaged pattern combined photographically with said background printed matter and said cancellation term to further disguise said cancellation term.

3. The improved security document as set forth in claim 1 or 2 wherein said alternating sized elements of said cancellation term comprises, first size elements of a lower frequency than said elements of said background printed matter and second size elements located in an alternating pattern in exact registration with said first size elements.

4. The improved security document as set forth in claim 3 wherein said first size elements of said cancellation term are uniform and larger than said elements of said background printed matter and said second size elements are uniform and smaller than said elements of said background printed matter.

5. The improved security document as set forth in claim 4 wherein the combined frequency of said first and said second size elements of said cancellation term is identical in frequency to that of said background printed matter.

6. The improved security document as set forth in claim 5 wherein the individual frequency of said first and said second size elements of said cancellation term are each equal to one-half the frequency of said elements of said background printed matter.

7. An improved security document comprising:

a substrate having a top surface for carrying indicia;

background printed matter on said top surface, said background printed matter made up of a uniform pattern of small elements of substantially the same size and of a uniform frequency; and a cancellation term also printed on said top surface of said substrate, said cancellation term consisting of a plurality of first size elements arranged in a uniform array and occurring at one-half the frequency of said background printed matter elements and having a size larger than said background printed matter elements, and of a plurality of second size elements arranged in a uniform array which is intermingled between said first size elements and occurring at one-half the frequency of said background printed matter elements and having a size smaller than said background printed matter elements, such that said array of said first size elements, said array of said second size elements and said pattern of said background printed matter elements are all in register.

* * * * *